United States Patent [19]

Schepper

[11] 4,427,455

[45] Jan. 24, 1984

[54] BARREL CLEANING METHOD

[75] Inventor: Manfred Schepper, Herford, Fed. Rep. of Germany

[73] Assignee: Leifeld & Lemke Machinenfabrik & Co. GmbH, Rahden, Fed. Rep. of Germany

[21] Appl. No.: 347,960

[22] Filed: Feb. 11, 1982

[30] Foreign Application Priority Data

Jan. 15, 1981 [DE] Fed. Rep. of Germany ..... 3101006

[51] Int. Cl.[3] ..... B08B 9/12; B08B 9/10

[52] U.S. Cl. ..... 134/22.18; 134/22.12; 134/30

[58] Field of Search ..... 134/24, 30, 37, 21, 134/22.12, 22.18, 22.1

[56] References Cited

U.S. PATENT DOCUMENTS

| | | | |
|---|---|---|---|
| 1,816,555 | 7/1931 | Ward | 134/22.12 |
| 2,378,324 | 10/1945 | Glickman | 134/22.1 |
| 4,140,543 | 2/1979 | Soleri et al. | 134/22.18 |
| 4,287,903 | 9/1981 | Cessou | 134/24 X |

FOREIGN PATENT DOCUMENTS 1907416 12/1970 Fed. Rep. of Germany .

*Primary Examiner*—Robert L. Lindsay, Jr.

[57] ABSTRACT

The cleaning of barrel type containers, particularly beer kegs which have a fitting including a riser pipe which extends into the keg, is accomplished by incrementally increasing the level of a cleaning liquid which has been introduced into the barrel and, between each step of injection of cleaning fluid, causing turbulent motion of the liquid in the barrel by means of the injection of preselected volumes of a gaseous medium at a point below the surface level of the liquid cleaning fluid.

7 Claims, 3 Drawing Figures

BARREL CLEANING METHOD

BACKGROUND OF THE INVENTION (1) Field of the Invention

The present invention relates to the cleaning of barrel-like containers and particularly to the cleaning of the interior surfaces of beer kegs. More specifically, this invention is directed to apparatus for use in the internal cleaning of barrels and especially to apparatus which cooperates with a barrel fitting, the fitting including a riser pipe extending into the barrel and check valves associated therewith. Accordingly, the general objects of the present invention are to provide novel and improved methods and apparatus of such character.

(2) Description of the Prior Art

While not limited thereto in its utility, the present invention is particularly well suited for use in the cleaning of the internal surfaces of beer kegs. Such kegs or barrels are typically provided with a barrel fitting which remains in one end of the barrel. This fitting includes the usual check valves which permit the barrel to be charged and subsequently emptied. The barrel fitting also includes a riser pipe which extends from the fitting to a point adjacent the opposite end of the barrel.

The obtaining of satisfactory cleaning of beer kegs subsequent to their use, to thereby permit refilling and thus reuse, is a problem of long standing in the art. German Pat. No. 1,907,416 discloses a keg cleaning and filling technique which may be performed in fully automated fashion. In the process of German Pat. No. 1,907,416 the cleaning fluid employed to wash the internal barrel surfaces is introduced via the barrel fitting riser pipe and thus is injected into the barrel under pressure from the end of the riser pipe. The thus injected cleaning fluid will be deflected off the end of the barrel which faces the open end of the riser pipe and will then flow down the inner side wall of the barrel. The cleaning action which is achieved is enhanced by imparting a suitable shape to the interior wall of the barrel end, i.e., the end known in the art as the "cup", against which the injected cleaning fluid impinges. In the process of German Pat. No. 1,907,416 the cleaning fluid will be removed from the barrel via the passage in the barrel fitting through which compressed gas is introduced during normal usage. The degree of cleaning achieved with the technique and apparatus of German Pat. No. 1,907,416 depends on several factors such as, for example, the design of the barrel and particularly the end wall against which the cleaning fluid impinges, the distance between the end of the riser pipe and the facing barrel wall, the pressure of the cleaning fluid and the quantity of the cleaning fluid. Due to an inability to accurately control all of these variables, the desired cleaning and sterilizing effect has not always been achieved.

It is also to be noted that the cleaning technique of German Pat. No. 1,907,416, in an effort to obtain cleaning of the riser pipe and other parts of the barrel fitting which are exposed to the interior of the barrel, contemplates the reduction in the pressure of the cleaning fluid delivered at the end of the cleaning cycle in the interest of having the fluid flow down the exterior surfaces of the riser pipe. This, however, has proven to be a very ineffective manner of achieving thorough cleaning and sterilizing of the fitting and pipe.

It is also known in the art to perform what is known as interval cleaning. Such "interval cleaning" requires the modulation of a supply of compressed air such that the air is injected into the cleaning fluid being delivered through the riser pipe in bursts or slugs. This results in introduction of the cleaning fluid into the barrel from the riser pipe in the form of discharges which resemble explosions with the result being that annular shock waves will run along the barrel wall from top to bottom. Such "interval cleaning" has, however, also proven to be unsatisfactory since there was no way to insure that all parts of the interior of the barrel will be washed by the cleaning fluid. Restated, the formation of an unbroken cleaning film is prevented because of the periodic interruptions in flow caused by the periodic injection of pressurized air.

A further example of a prior art barrel cleaning process and apparatus is disclosed in published German Application No. 2,706,590. The primary purpose of the apparatus of this published application is to achieve improved cleaning of the riser pipe and barrel fitting housing. This is reportedly accomplished by performing an additional operation, upon completion of the conventional above-described internal cleaning operation, during which the cleaning fluid is alternately caused to flow into the barrel through the riser pipe and the compressed gas supply valve of the barrel fitting. During the delivery of the cleaning fluid to the interior of the barrel via the compressed gas valve, the fluid will to some extent wash the outer surface of the riser pipe.

A further example of a process for the internal cleaning of barrels, particularly beer kegs, is disclosed in published German Pat. Application No. 2,720,320. This further prior art technique requires subjecting the barrel to a cleaning fluid which is at a relatively high temperature and at an appropriate saturation pressure in the interest of quickly and positively destroying microorganisms.

All of the known prior processes and apparatus for use in the cleaning of barrels, and particularly beer kegs which are provided with a barrel fitting, have one or more deficiencies. A common characteristic of the prior art techniques has been a lack of the ability to insure that all interior surfaces of the barrel to be cleaned, including the barrel fitting, will be contacted by the cleaning fluid. Accordingly, there has been an inability to reliably clean barrels, especially beer kegs, to the degree necessary and this is particularly true of those barrels which were relatively severely soiled.

SUMMARY OF THE INVENTION

The present invention overcomes the above-discussed and other deficiencies and disadvantages of the prior art by providing a novel and improved technique for the internal cleaning of barrels and kegs whereby the sterilization thereof is achieved in an effective and reliable manner and in a comparatively short period of time. The present invention also encompasses apparatus for use in the practice of this novel method.

In accordance with the present invention, a cleaning fluid is introduced into the barrels to be cleaned and is set in turbulent motion by the injection, from beneath the surface of the thus introduced cleaning liquid, of a gaseous or vaporous medium. A pressure differential is maintained between the interior of the barrel and the source of the gaseous or vaporous medium during the cleaning. In accordance with a preferred embodiment, the cleaning liquid is introduced in increments such that the level of cleaning fluid in the barrel is increased in stepwise fashion. The gaseous or vaporous medium which causes the turbulence in the cleaning fluid is injected between the incremental steps of addition of cleaning liquid.

As an alternative to the above-described preferred embodiment, it is possible to simultaneously inject the cleaning liquid and gaseous medium into the barrel to be cleaned.

The present invention also contemplates the increase in the pressure of the gaseous or vaporous medium which causes the turbulence in the cleaning liquid as the level of cleaning liquid in the barrel increases.

In accordance with the present invention, when the barrel being cleaned includes a barrel fitting having a riser pipe which extends into the barrel, the cleaning liquid is introduced via this riser pipe and the gaseous or vaporous medium is injected via the valve through which the compressed gas would be introduced to pressurize the barrel when it is full of the contents which are to be dispensed. In the practice of the preferred embodiment of the invention, as described above, the required pressure differential is maintained by employing the riser pipe as a return line for gas during the introduction of gas into the barrel to promote turbulence in the cleaning liquid. It should also be noted that it is within the scope of the invention to employ a liquid, rather than a gas, to create the desired turbulence.

Apparatus in accordance with the invention comprises a cleaning head which may be connected to the barrel fitting. This cleaning head is provided with passages which communicate with cleaning liquid and compressed gas supply and discharge conduits. The apparatus is further characterized by the use of valves in the supply and discharge conduits, these valves being controllable in order to achieve the stepwise filling of the barrel with the cleaning liquid and the coordinated supply of bursts of gas or vapor. Apparatus in accordance with the preferred embodiment of the invention further comprises a return line for gas or vapor delivered into the barrel being cleaned, this return line being coupled to the cleaning liquid supply conduit downstream of the liquid supply control valve. The return line will include a further valve which may be opened during the injection of gas or vapor into the barrel to maintain a desired barrel internal pressure.

The preferred embodiment of the invention also includes a valve in the gas or vapor supply line which functions to deliver gas to the interior of the barrel being cleaned in the form of slugs or bursts.

BRIEF DESCRIPTION OF THE DRAWING

The present invention may be better understood and its numerous objects and advantages will become apparent to those skilled in the art by reference to the accompanying drawing wherein like reference numerals refer to like elements in the several figures and in which.

DESCRIPTION OF THE DISCLOSED EMBODIMENT

Figure 2:
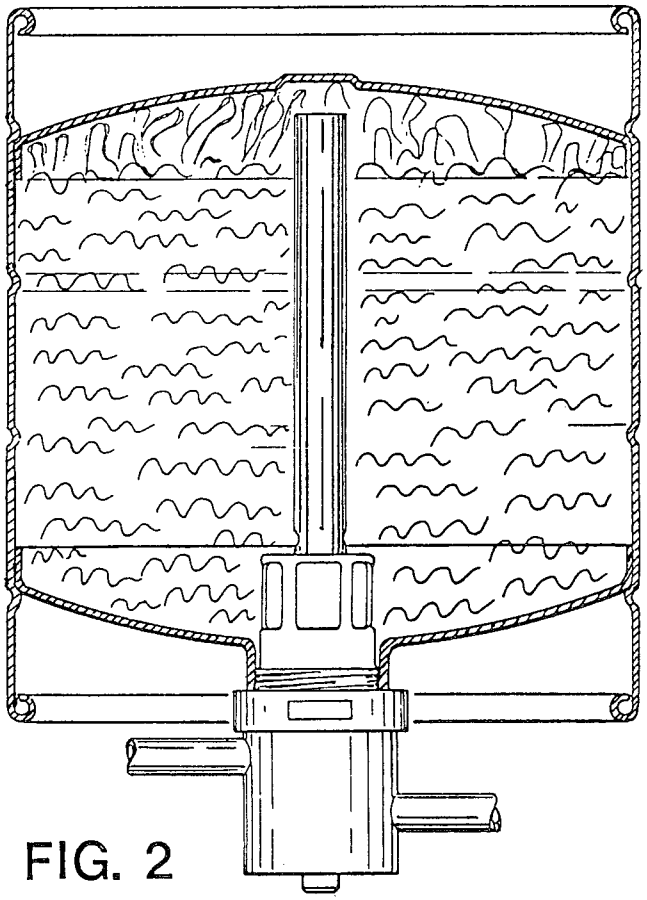
FIG. 2 is a view similar to FIG. 1 immediately prior to the end of the cleaning procedure.
Figure 1:
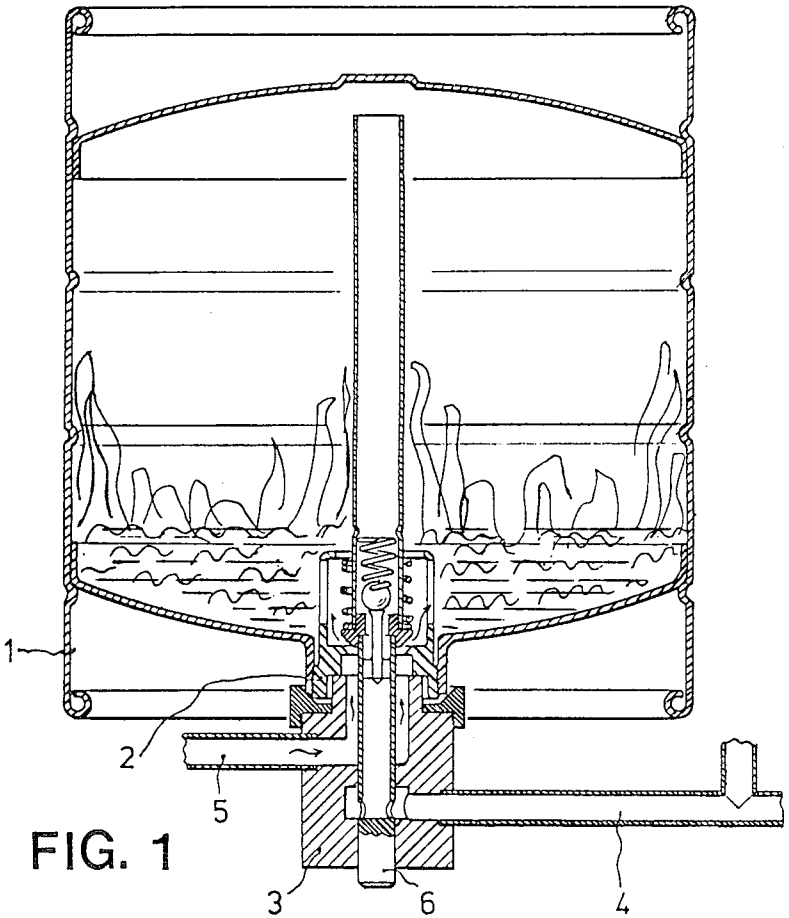
FIG. 1 is a cross-sectional side elevation view which depicts the use of the present invention shortly after initiation of a barrel cleaning procedure.
Figure 3:
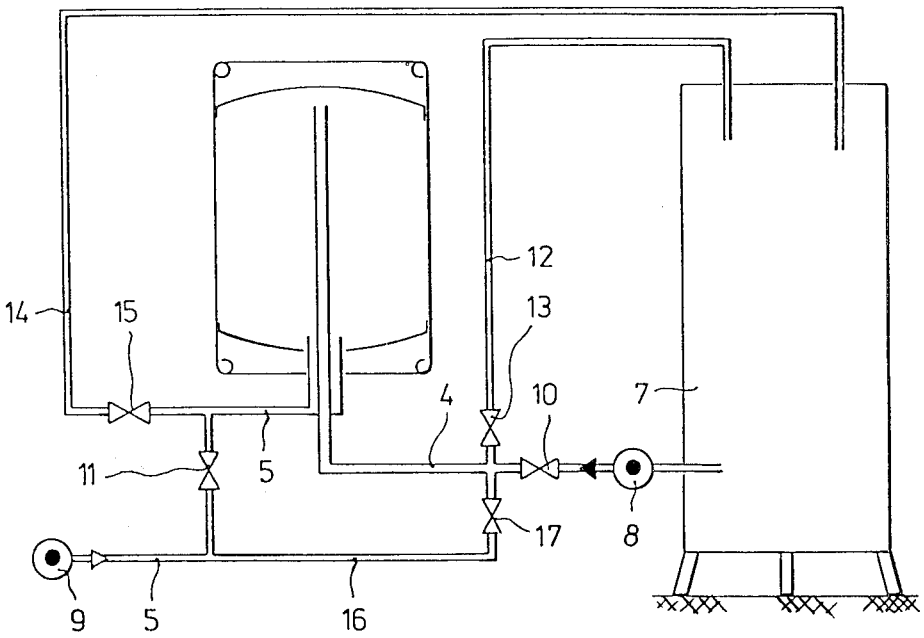
FIG. 3 is a schematic diagram of apparatus in accordance with the present invention, the apparatus of FIG. 3 including the cleaning head shown in FIGS. 1 and 2.

Referring to FIGS. 1 and 2, the initiation and conclusion of the cleaning of a container 1 are respectively shown. The container 1 is a beer keg which includes a barrel fitting 2. Apparatus in accordance with the present invention comprises a cleaning head 3 which engages the barrel fitting 2. The barrel fitting comprises a housing which defines a compressed gas supply passage and a coaxial passage through which liquid being discharged from the container during normal usage may flow. The liquid flow passage is coupled to a riser pipe which extends from the barrel fitting to a point adjacent to the opposite end of the container. The central portion of the barrel fitting, i.e., the portion to which the riser pipe is affixed, is movable axially and cooperates with the fitting housing to define a gas supply valve which is spring loaded to the closed position. The central portion of the fitting further includes an additional spring loaded ball-type valve which cooperates with the passage which is in communication with the interior of the riser pipe. When the cleaning head 3 is coupled to the barrel fitting, both valves in the fitting will be forced to the open position shown in FIG. 1 and the riser pipe with thus be directly coupled to a cleaning liquid supply conduit 4 while the interior of the vessel will be coupled, via the open gas supply valve, to a compressed gas supply conduit 5.

The gas and liquid flow control valves in the barrel fitting 2 will be opened by means of an actuating plunger 6 in cleaning head 3. Accordingly, a cleaning liquid which is delivered via supply conduit 4 may flow through the hollow stem of plunger 6 and up the riser pipe of the barrel fitting to be discharged into the container 1. The compressed gas delivered to the cleaning head via conduit 5 will enter container 1 adjacent the end which, as the container is depicted in the drawing, constitutes the bottom. Thus, the cleaning liquid enters adjacent the top of the container to be cleaned and flows to the bottom while the compressed gas, which promotes turbulence in the cleaning liquid, is delivered at the bottom of the container and thus must flow upwardly through the cleaning liquid. In the cleaning operation the compressed gas supply conduit 5 will also function as a return line through which the cleaning liquid may be routed back to a reservoir.

Referring jointly to all of the figures, a cleaning process in accordance with the present invention is initiated by the introduction of a cleaning liquid into the container 1 to be cleaned via the riser pipe of the barrel fitting. This cleaning liquid is stored in a reservoir tank 7 and pumped to container 1 by a pump 8. After a first liquid level is reached in container 1, this first level being that indicated in FIG. 1, the pump 8 is shut off and a valve 10 in supply conduit 4 will prevent the back flow of liquid or gas to pump 8. The internal cleaning of the riser pipe will, of course, occur simultaneously with the delivery of the cleaning liquid to the interior of the container 1 therethrough.

The next step in the cleaning process comprises the delivery, via supply conduit 5, of compressed air or other gas from a suitable source 9. As noted above, the compressed gas enters the container 1 below the surface level of the cleaning liquid and, accordingly, causes turbulent motion of the cleaning liquid. This turbulent motion insures the thorough washing of all internal surfaces in the container.

The blowing operation described immediately above is terminated after a preset period of time, for example by turning off the compressor which functions as the compressed air source 9. Back flow of gas from the container 1 will, upon termination of the delivery of compressed gas, be prevented by a valve 11.

The cleaning process will typically be automatically controlled pursuant to a program and the delivery of liquid and the supply of compressed gas will be alternated in steps of predetermined length. These steps will continue until the level of liquid in the container 1 reaches that shown in FIG. 2. It should be noted that the duration of the various liquid and gas delivery steps will typically be a function of the degree of soiling of the container. When the cleaning liquid reaches the level depicted in FIG. 2, the turbulence periodically imparted to this liquid will have resulted in all exposed interior surfaces in container 1 having been contacted by cleaning liquid and reliably cleaned. The surfaces thus cleaned will, of course, include the exterior of the riser pipe and the interior and exterior surfaces of the barrel fitting.

In order to maintain the necessary pressure differential during the cleaning operation, and particularly during the delivery of the bursts of compressed gas to the interior of container 1, gas may exit the container via the riser pipe and the cleaning liquid supply conduit 4. Any such gas exiting container 1 will be delivered, via a return air conduit 12, to the interior of cleaning liquid supply tank 7. The conduit 12 will be provided with a valve 13 which may either be automatically controlled or preset to open at a selected pressure. The conduit 12 is coupled to conduit 4 at a point downstream of valve 10.

As an alternative to the preferred cleaning procedure described above, the delivery of cleaning liquid and compressed gas to the interior of container 1 may occur simultaneously. Additionally, through a modification of the apparatus, both the cleaning liquid and the compressed gas may be injected at the bottom of the container.

It is also to be noted that the present invention does not require an "overhead" cleaning of the containers or barrels 1 as depicted in the drawing. Thus, in the case of barrels having an upwardly directed fitting, the flow paths for the cleaning liquid and compressed gas may be interchanged whereupon the gas will be delivered via the riser pipe but will still be supplied at a point below the surface level of the cleaning liquid.

The present invention also contemplates the variation of the pressure at which the gas is supplied. Such pressure variations may be achieved through the exercise of control over the valve 11.

It will also be understood that, rather than using compressed gas, other pressurized fluids may be employed in the practice of the present invention. Thus, for example, a vapor or a liquid can be injected via the supply conduit 5.

At the termination of the cleaning procedure, the cleaning liquid is forced out of the container 1 through the compressed-gas supply valve in the barrel fitting and, via conduit 5, into a further conduit 14. The cleaning fluid is then delivered, via the conduit 14, back to the reservoir tank 7. During this procedure a normally closed valve 15 in conduit 14 will, of course, be opened. The cleaning liquid will be forced out of container 1 by means of the delivery of the compressed gas to the interior of the container through the barrel fitting riser pipe. This is accomplished by establishing connection with the compressed gas supply 9 by means of closing the valves 11, 10 and 13 and opening a valve 17 in a branch conduit 16.

Thus, as should now be obvious to those skilled in the art, the process and apparatus of the present invention produces a substantially improved internal cleaning of barrels, especially beer barrels, and in so doing guarantees that no part of the internal vessel surfaces, including the outer surface of the riser pipe and the barrel fitting housing, will fail to be thoroughly washed. The cleaning process in accordance with the present invention proceeds from the bottom of the barrel or other container being cleaned upwardly and the number of steps employed in the cleaning process may be varied as necessary to achieve a very intense washing operation.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. A process for the internal cleaning of containers, the containers including a fitting which remains in a first end thereof, the fitting having a riser-pipe projecting into the container and further having at least a pair of passages therethrough, one of the fitting passages communicating with the riser pipe, the fitting also including valves which normally close the said passages, the process comprising the steps of:

introducing a cleaning liquid into the container;

periodically causing turbulence in the cleaning liquid in the container without moving the container by introducing a pressurized fluid into the container at a point below the surface level of the cleaning liquid previously introduced; and releasing gas from the container at a point above the surface level of the introduced cleaning liquid to thereby limit the pressure in the container to a preselected level and to maintain a difference between the container interior pressure and the pressure of the turbulence causing fluid during the cleaning process.

2. The process of claim 1 wherein the level of the cleaning fluid in the container is incrementally increased and the turbulence is produced between the introduction of the increments of cleaning liquid.

3. The process of claim 1 wherein the cleaning liquid and the fluid which produces the turbulence therein are simultaneously introduced into the container.

4. The process of claims 1, 2 or 3 wherein the turbulence in the cleaning liquid is caused by the introduction into the container of volumes of gas of preselected quantity and pressure.

5. The process of claim 1 wherein the container is a barrel, the cleaning liquid is delivered to the interior of the barrel via the riser pipe of the fitting and the turbulence is caused by the injection of a compressed gas.

6. The process of claim 5 wherein the level of the cleaning fluid in the container is incrementally increased and the turbulence is produced between the introduction of the increments of cleaning liquid.

7. The process of claim 6 wherein the pressure of the gas introduced is increased during a cleaning operation in accordance with a preselected schedule.

* * * * *